US010099235B2

(12) United States Patent
Reale

(10) Patent No.: US 10,099,235 B2
(45) Date of Patent: Oct. 16, 2018

(54) HANDHELD PRESSURE WASHER

(71) Applicant: Louis Reale, Kilauea, HI (US)

(72) Inventor: Louis Reale, Kilauea, HI (US)

( * ) Notice: Subject to any disclaimer, the term of this patent is extended or adjusted under 35 U.S.C. 154(b) by 0 days.

(21) Appl. No.: 14/558,059

(22) Filed: Dec. 2, 2014

(65) Prior Publication Data

US 2016/0151799 A1 Jun. 2, 2016

(51) Int. Cl.
*B05B 9/04* (2006.01)

(52) U.S. Cl.
CPC ..... *B05B 9/0426* (2013.01); *B05B 9/0416* (2013.01)

(58) Field of Classification Search
CPC ..... B05B 12/00; B05B 9/01; B05B 12/002; B05B 9/0426; B05B 9/0416
USPC ..... 239/526–532; 222/75, 333–334; 417/66–67, 78
See application file for complete search history.

(56) References Cited

U.S. PATENT DOCUMENTS 3,993,250 A * 11/1976 Shure ..... B05B 9/0866 222/383.2
4,021,150 A * 5/1977 Mabuchi ..... B63H 11/08 401/146
4,621,770 A * 11/1986 Sayen ..... B05B 1/16 239/304
5,169,068 A * 12/1992 Bertolini ..... B05B 7/2464 239/154
5,421,520 A 6/1995 Simonette
5,669,558 A 9/1997 Ichel
6,595,437 B1 * 7/2003 Lawson ..... A47L 9/244 239/119
7,121,433 B2 * 10/2006 Nelson ..... F04D 13/024 222/333
7,854,398 B2 12/2010 Hahn
2002/0008152 A1 * 1/2002 Yahav ..... B65D 83/262 239/1
2006/0013709 A1 1/2006 Hudson

* cited by examiner

*Primary Examiner* — Chee-Chong Lee
(74) *Attorney, Agent, or Firm* — Global Intellectual Property Agency, LLC; Daniel Boudwin

(57) ABSTRACT

A handheld pressure washer device is provided that is electrically driven and does not require an external pump. The device comprises a handle section, a barrel section, and a water intake that is configured to secure to a standard water hose. The device includes a battery pack or connection to an external electrical power source, which delivers electrical power to an electric motor within the barrel section. The electric motor drives a driveshaft, which imparts rotary motion on an impeller within the barrel section. The impeller pressurizes and accelerates water within a conduit, causing the water to rapidly pass through a stator and through the outlet of the device. The speed of the electric motor is controlled by a user trigger, while the intake and outlet include coupling to affix attachments and water hoses thereto, respectively. The device provides a compact, handheld unit for pressurizing water from a hose.

7 Claims, 1 Drawing Sheet

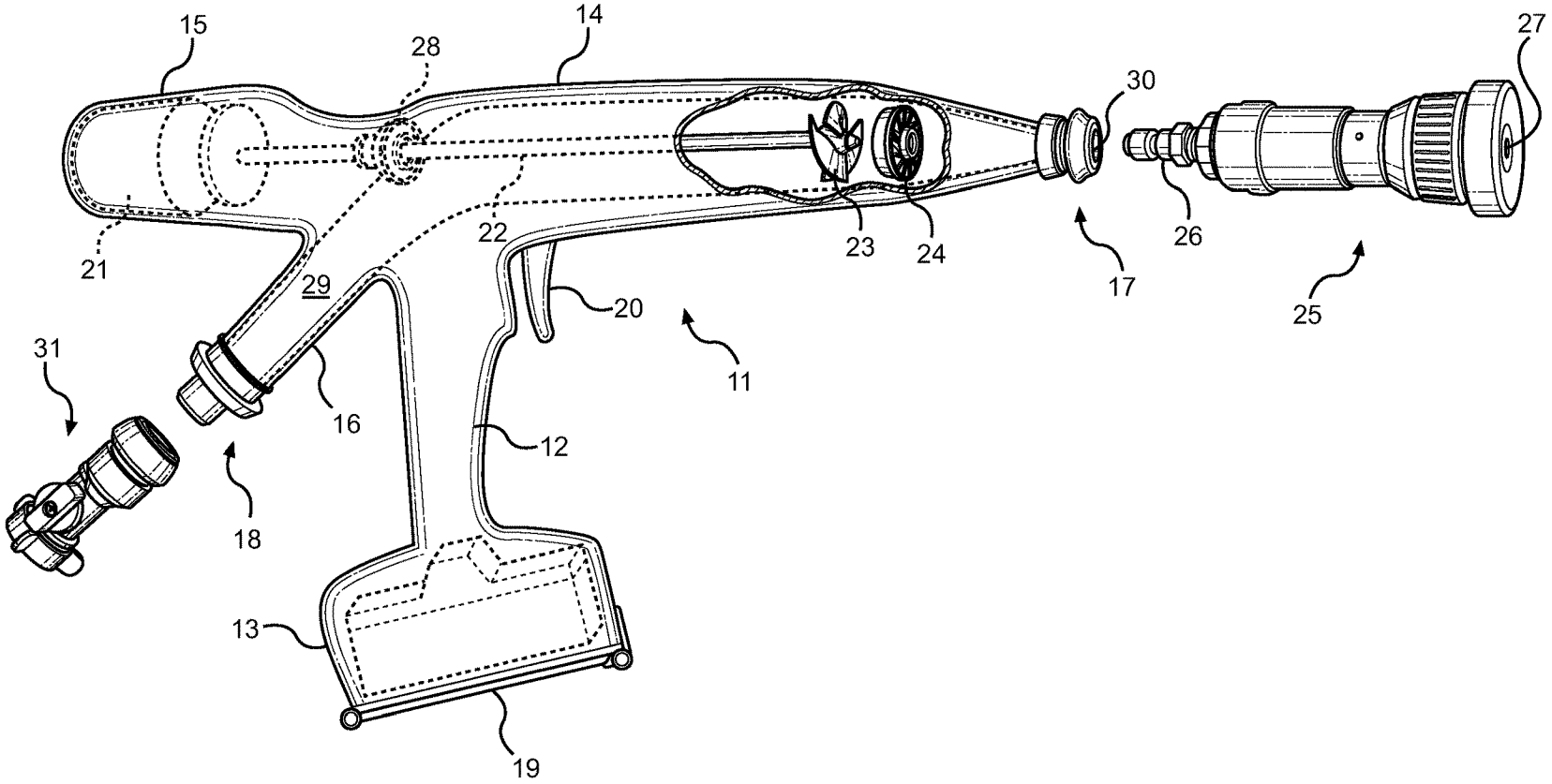
27
25
26
30
17
24
23
11
14
20
12
19
22
28
29
16
18
13
15
21
31

HANDHELD PRESSURE WASHER

BACKGROUND OF THE INVENTION

Field of the Invention

The present invention relates to compact pressure washers and those that do not require an independent water pump or pressure source to pressurize outgoing fluid. More specifically, the present invention relates to a handheld pressure washer that includes an electrically driven impeller to pressurize fluid and expel the same a handheld appliance in connection only with a water source.

Traditional pressure washers generally include either a pump powered by an internal combustion engine, or a compressed air source. The former is a large apparatus that is not easily transported or wielded when desired. The pump requires fuel to burn, and the bulkiness of the assembly limits its application. Those pressure washers that employ a compressed air source either require an air compressor or a reservoir of compressed air. Air compressors, like internal combustion engines, are large devices that pressurize air within a large reservoir. These two different pressure washer devices share similar drawbacks related to portability and overall bulkiness of the system.

For those who infrequently have a need for pressure washers but would like to employ high pressure fluid for cleaning and clearing debris, a choice is required. Users must purchase a large, expensive pressure washer assembly or forego the utility of such an appliance. What is needed is therefore a new appliance that does not require such a choice. A handhold pressure washer assembly is desired that a user can readily transport, deploy, and stow the pressure washer assembly and readily use the same when desired.

The present invention provides such a handheld assembly, whereby an electrically driven pressure washer assembly pressurizes water from a water hose and allows the user to pressure wash a vehicle or clear an area of debris using the same. The assembly comprises a handheld device having a handle, a barrel section, and a water inlet. Within the handle is a battery pack, which supplies electrical power to a high speed motor within the rear of the barrel section. The motor drives a driveshaft within the barrel, which supports an impeller. Water is received through the water inlet and directed into the barrel, whereby the impeller pressurizes it and accelerates it through a nozzle disposed along the distal end of the barrel. A user trigger controls the speed of the motor, and thus the speed of the impeller and the pressure/flow rate of the exiting fluid. In this way, the assembly is handheld, electrically driven, and provides operatively controlled flow from the device to pressure wash or to gently apply water to a surface using the trigger control. The assembly is readily deployable with a standard garden hose or the like.

Description of the Prior Art

Devices have been disclosed in the prior art that relate to pressure washer devices. These include devices that have been patented and published in patent application publications. These devices generally relate largely to various constructions for handheld pressure washer devices. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 7,854,398 to Hahn, which discloses a handheld pressure washer device that comprises a spray gun housing supporting a pump within the housing. The pump and handle of the device are separate structures that are attached, whereby the pump housing secures to handle of the pressure washer and is supported by a stanchion. Fluid is pressurized within the pump and entered through the handle of the pressure waster, and then directed to the distal spray nozzle. By contrast, the present invention contemplates a motor housing disposed along the rear portion of a handled pressure washer, whereby the motor drives a driveshaft disposed within the barrel of the pressure washer, which in turn includes an impeller and vane stator for pressurizing the fluid within the pressure washer just upstream from the nozzle thereof.

U.S. Pat. No. 5,421,520 to Simonette discloses a portable pressure washer that employs a two-cycle internal combustion engine to drive a positive displacement pump. Incoming water from a water hose connection is pressurized and jettisoned through a substantially rigid spray wand, whereby the user supports the wand by the engine housing and via a secondary handle. The Simonette device is similar to a weed trimmer device; however, the engine drives a water pump and the elongated wand supports water therethrough. The present invention, by contrast, is a handheld pressure washer device in forming a handle and a barrel section. An electric motor within the barrel drives an impeller to pressurize fluid being forced through its distal end nozzle.

Another device is U.S. Patent Publication No. 2006/0013709 to Hudson, which discloses a battery powered spray wand that is useful for spraying liquids, such as water, pesticides and the like. The device includes a liquid pump, batteries, a motor, and a water pump. A flexible intake hose secures the device to a reservoir of liquid to be dispensed. While the Hudson device relates to electrically driven pumps, the device is not suited for pressure washing or ejecting high pressure water from its nozzle. The Hudson device is related to liquid dispensers and spray pumps. The present invention has a construction that facilitates high water pressure at the nozzle outlet for pressure washing without using an external power source.

Finally, U.S. Pat. No. 5,169,068 to Bertolini discloses a pressure washing device that includes a piston pump within a lance that can continuously eject high pressure water from its nozzle using an electric motor and reduction gear. Further included is an attached container of detergent that can mix with the outgoing fluid. The present invention, by contrast, contemplates an electric motor-driven assembly, in which water is pressurized and accelerated through a nozzle using a rotary impeller and stator.

Overall, the configuration and the means of pressurizing fluid contemplated by the present invention diverges from the prior art. The present invention presents a new and improved handheld pressure washer assembly that addresses a clear need in the art. The present invention substantially fulfills these needs by providing an electrically driven, handheld pressure washer assembly that can pressurize water without an external power source while using a standard garden hose. The present invention improves access to pressure washer tools by providing a more compact, economical assembly that can facilitate increased water pressure for several applications.

SUMMARY OF THE INVENTION

In view of the foregoing disadvantages inherent in the known types of pressure washers now present in the prior art, the present invention provides a new handheld pressure washer appliance, wherein the same can be utilized for providing convenience for the user when pressure washing an area using a handheld device and a standard garden hose.

It is therefore an object of the present invention to provide a new and improved pressure washer device that has all of the advantages of the prior art and none of the disadvantages.

It is another object of the present invention to provide a pressure washer device that includes a handheld design, whereby a handle, a barrel section, and a water intake port is provided that can connect to a standard garden hose and be used without an external power source.

Another object of the present invention is to provide a pressure washer device that includes a high speed impeller that is driven by an elongated driveshaft within the barrel section.

Yet another object of the present invention is to provide a pressure washer device that includes an electric motor and a power source, whereby the electric motor drives the impeller drive shaft and the speed of the driveshaft is controlled by a user trigger between the handle and the barrel section.

Another object of the present invention is to provide a pressure washer device that controls the flow rate and pressure of the exiting fluid using the speed of the impeller, and thus the position of the trigger, whereby the user can control the water exiting the device for different applications using the trigger mechanism.

Another object of the present invention is to provide a pressure washer device that includes an outlet having a coupler that can be used to affix various attachments to the end of the device, including various nozzles and wands.

Another object of the present invention is to provide a pressure washer device that includes an internal conduit through which water from a water hose is received, whereby the electrical components of the assembly are sealed from the conduit and unwanted interaction is prevented.

A final object of the present invention is to provide a pressure washer device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 shows a side view of an exemplary embodiment of the handheld pressure washer of the present invention.

DETAILED DESCRIPTION OF THE INVENTION

Reference is made herein to the attached drawings. Like reference numerals are used throughout the drawings to depict like or similar elements of the handheld pressure washer of the present invention. For the purposes of presenting a brief and clear description of the present invention, the preferred embodiment will be discussed as used for pressurizing water from a garden hose for applying high pressure and high velocity water over an area without using an external water pump or compressor. The figures are intended for representative purposes only and should not be considered to be limiting in any respect.

Referring now to FIG. 1, there is shown a side view of an exemplary embodiment of the present invention. The present invention comprises a handheld pressure washer device that can pressurize water from a garden hose without employing a standalone pump, as is required with traditional pressure washer devices. The device comprises a spray gun configuration that includes a handle section 12, a barrel section 14, a water inlet 16 and a water outlet 30. A garden hose or similar water hose supply is connected to the water inlet 16, which allows communication of fluid into an internal conduit 29 within the device. The internal conduit 29 extends from the water inlet 16 to the water outlet 30, wherebetween the water is accelerated and forced through the outlet 30 at much higher pressure and velocity than the incoming water in the inlet 16.

Driving the water within the conduit 29 as it travels through the barrel section 14 is an axial flow impeller 23, which is a rotary device having vanes that transfer rotational motion into axial fluid motion of the water within the barrel 14. The impeller 23 increases the pressure of the water and increases its flow rate as it leaves the outlet 30 of the device. Downstream of the impeller 23 is a stator 24, which guides the flow of fluid into the outlet 30 and directs the energy of the fluid from the impeller towards the outlet 30 to improve efficiency. The stator 24 comprises a substantially circular device with a plurality of radial vanes that direct flow therethrough.

The impeller 23 is driven by an elongated driveshaft 22 within the barrel section 14, which in turn is driven by an electric motor 21 along the rear portion of the barrel 14 and along an opposite end with respect to the outlet 30. The driveshaft 22 rotates and drives the impeller 23, and is positioned within the flow of water and within the conduit 29 of the device. The electric motor 21 is retained within a motor housing 15 behind the handle 12 and is separated from the conduit 29 (and from contact with flowing water). The drive shaft 22 is coupled to the electric motor output, and extends through a sealed aperture 28 in the rear wall of the conduit. The aperture includes a suitable seal that prevents water from exiting the conduit 29 and entering the motor housing 15, while still permitting rotary motion of the driveshaft therein.

The electric motor 21 is driven by a power source either disposed within the handle 12 of the device, or by an external electrical power source and a wired connection to a transformer disposed within the handle 12. In the preferred configuration, a battery pack is disposed within a battery housing 13 along the lower end of the handle portion 12. The battery pack is a removable structure that provides electrical power to the electric motor 21, which in turn is translated into rotary motion of the impeller 23. The battery pack is removable via a door 19 along the base of the battery housing 13, whereby a suitable replacement may be loaded. The battery pack is preferably rechargeable and provides suitable power to drive a motor 21 of suitable torque and speed to sufficiently pressurize the water using the impeller 23. The alternative configuration contemplates a wired connection to an AC electrical cord, whereby a transformer within the handle portion 12 transforms the AC voltage into DC voltage for the motor 21.

Controlling the speed of the driveshaft 22, and thus the velocity/pressure of the outgoing water is a trigger 20 disposed at the apex of the handle portion 12 and the barrel portion 14. The trigger 20 is a hinged mechanism that changes the speed of the motor 21 based on its position relative to the handle 12. Preferably, the trigger 20 is connected to a potentiometer or other suitable current or voltage regulator, whereby the position of the trigger changes the current being supplied to the motor 21 and thus the speed at which it turns the driveshaft 22. The trigger 20 is necessary to operably control the pressure of outgoing water, whereby the pressure can be regulated for different applications.

To operate the device, a water hose is first connected to the water inlet 16. To accomplish this connection, the inlet preferably comprises a coupler 18 that facilitates connection of a water hose or connection to an intermediate connector. The coupler may comprise a threaded member or a quick disconnect coupler. A garden hose or similar water hose can be directly connected to the inlet 16, or alternatively intermediate connection may be connected thereto. As shown in FIG. 1, the intermediate connectors may comprise valved connectors 31 with appropriate couplers to afford connection of various types of hoses and hose couplings desired by the user. It is not desired to limit the design of the inlet or the specific coupler affixed thereto.

Similarly along the outlet 30, a specific coupler 30 may be disposed thereon that affords either threaded connections or quick disconnect connection; however, it is not desired to limit the design of the outlet to one specific coupler or connector. As shown in FIG. 1, the outlet may comprise a quick disconnect coupler 17 that affixes to a quick disconnect member 26 of a nozzle attachment 25. The nozzle may provide for different spray patterns through the nozzle outlet 27, whereby pressurized water from the barrel 14 is received by the nozzle 25 and the nozzle provides a desired spray for specific application.

The trigger 20 controls the flow rate and pressure of the exiting fluid, whereby the user can apply a high pressure fluid or a gentle flow of water onto a work piece. The trigger 20 controls the speed of the motor, and therefore the speed of the driveshaft and the impeller. Therefore, the user pulls the trigger 20 for increased water pressure. The trigger 20 is preferably spring biased to return to its starting position, whereby the user can release the trigger or place less pressure on the trigger 20 for reduced flow rates. The ability to operably control the flow rate and choose between pressure washing and gentle application of fluid is a unique feature of the present invention.

Overall, the present invention provides a handheld pressure washer device that is electrically powered and readily deployable without an external pump. The device derives power from a battery power pack, or alternatively a power cord and AC power. The electrical power drives an electric motor 21, which in turn drives an impeller 23 that pressurizes and accelerates the flow of water form a hose connected to the water inlet 29 of the device. Therefore, a user can pressure wash a car, an outdoor area, or another surface without being required to invest in a large pump apparatus. The present invention is a readily deployable and stowable pressure washer assembly in the form of a spray gun, which is compact and economical.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handheld pressure washer device, comprising:

a rigid body having a handle section and a barrel section directly connected thereto, wherein the handle section extends away from the body forming an L-shaped configuration such that said barrel section extends forward of said handle section;

wherein the body further comprises a motor housing axially aligned with said barrel section and extending rearward of said handle section;

a water inlet comprising a channel extending from the body between said motor housing and said handle section;

said water inlet configured to operably connect to a water source hose;

a distal end of said barrel section comprising a water outlet;

wherein the water outlet is configured to expel fluid external the barrel section;

an internal conduit extending from said water inlet to said water outlet, said internal conduit comprising a sealed chamber allowing fluid communication between said water inlet and said water outlet;

said motor housing supporting an electric motor therein;

said electric motor connected to an elongated driveshaft and configured to operably impart rotary motion thereon;

said driveshaft connecting to a fluid impeller within said conduit;

said fluid impeller configured to pressurize and accelerate fluid through said water outlet when driven by said elongated driveshaft;

a trigger disposed at an apex between said handle section and said barrel section, said trigger being electrically connected to said electric motor and operably controlling said electric motor speed;

a stator having a plurality of radial vanes; said stator disposed between said impeller and said water outlet;

a nozzle attachment having a nozzle outlet in fluid communication with a nozzle inlet, wherein the nozzle inlet is removably securable to the water outlet via a quick disconnect coupler;

wherein the nozzle attachment is configured to selectively produce one of a plurality of spray patterns.

2. The handheld pressure washer device of claim 1, further comprising:

a battery pack power source within said handle portion;

said battery pack power source being electrically connected to said electric motor and providing electric power thereto.

3. The handheld pressure washer device of claim 2, wherein said battery pack power source is removably from said handle portion.

4. The handheld pressure washer device of claim 1, wherein:

said elongated driveshaft extends through an aperture in a wall of said conduit;

a seal disposed between said elongated driveshaft and said aperture that prevents fluid from exiting said conduit while allowing said driveshaft to rotate therein.

5. The handheld pressure washer device of claim 1, wherein said water inlet comprises a water hose coupler.

6. The handheld pressure washer device of claim 1, wherein said water outlet comprises a water hose coupler.

7. The handheld pressure washer device of claim 1, wherein:

said handle portion further comprises an electric cord connector and a power transformer;

said electrical cord connector and said power transformer being in electrical connection with said trigger and said electric motor.

* * * * *